US006722805B1

(12) United States Patent
Skinner

(10) Patent No.: US 6,722,805 B1
(45) Date of Patent: Apr. 20, 2004

(54) TONGUE ADHERED DENTIFRICE APPARATUS

(76) Inventor: Rodney C. Skinner, 8th CES, PSC 2, Box 144, Apo Ap, NC (US) 96264-0002

( * ) Notice: Subject to any disclaimer, the term of this patent is extended or adjusted under 35 U.S.C. 154(b) by 0 days.

(21) Appl. No.: 10/316,482

(22) Filed: Dec. 11, 2002

(51) Int. Cl.[7] ..... B43K 5/14

(52) U.S. Cl. ..... 401/132; 401/6; 401/183; 15/167.1; 433/140; 433/216; 601/139

(58) Field of Search ..... 401/6, 132, 183, 401/268; 15/167.1, 104.93; 433/140, 216; 601/139

(56) References Cited

U.S. PATENT DOCUMENTS 3,853,412 A 12/1974 Griffin ..... 401/183
3,905,113 A * 9/1975 Jacob ..... 401/6
4,292,705 A * 10/1981 Stouffer ..... 15/167.1
4,585,416 A * 4/1986 DeNiro et al. ..... 433/140
4,748,709 A 6/1988 Oates ..... 15/104.93
4,884,581 A * 12/1989 Rescigno ..... 15/167.1
D321,987 S 12/1991 Oates ..... D4/106
5,921,255 A 7/1999 Garita ..... 132/329
6,065,967 A 5/2000 Garita ..... 433/216

* cited by examiner

*Primary Examiner*—Tuan N. Nguyen
(74) *Attorney, Agent, or Firm*—Sturm & Fix LLP

(57) ABSTRACT

A dentifrice apparatus (10) for cleansing the teeth and gum tissues of a user wherein, the apparatus (10) includes an enlarged head member (20) having a top surface (24) provided with a plurality of projections (25) and a bottom surface (23) adapted to be connected to the stem portion (31) of a suction cup member (30) the cup portion (32) of which releasably connects the apparatus (10) to a user's tongue (101) and a rupturable membrane (40) forming a reservoir for a supply of dentifrice material (50) that may be dispensed from a selected portion of the apparatus (10).

20 Claims, 1 Drawing Sheet

TONGUE ADHERED DENTIFRICE APPARATUS

CROSS REFERENCE TO RELATED APPLICATIONS

Not applicable.

BACKGROUND OF THE INVENTION

1. Field of the Invention

The present invention relates to the field of dentifrice devices in general and a tongue adhered dentifrice apparatus having a self-contained supply of mouthwash.

2. Description of Related Art

As can be seen by reference to the following U.S. Pat. Nos. Des. 321,987; 3,853,412; 4,748,709; 6,065,967; and 5,921,255, the prior art is replete with myriad and diverse dentifrice devices used to cleanse the teeth, mouth and gums of a user.

While all of the aforementioned prior art constructions are more than adequate for the basic purpose and function for which they have been specifically designed, they are uniformly deficient with respect to their failure to provide a simple, efficient, and practical dentifrice applying device that adheres to the user's tongue for cleansing the front and back of the user's teeth and gums while freshening the user's breath and reducing bacteria.

As most people are aware, it is relatively difficult with conventional straight shafted toothbrushes to reach the back surfaces of their teeth and gums while brushing their teeth resulting in a build-up of plaque and the retention of decaying food particles trapped between the rear surfaces of the teeth.

As a consequence of the foregoing situation, there has existed a longstanding need among people concerned with proper dental hygiene for a new and improved dentifrice apparatus that employs the user's tongue to clean both the front and the back surfaces of their teeth, massage the front and rear gum surfaces, as well as, dispensing a quantity of mouthwash to freshen and cleanse their mouth, and the provision of such an apparatus is the stated objective of the present invention.

BRIEF SUMMARY OF THE INVENTION

Briefly stated, the dentifrice that forms the basis of the present invention comprises in general a cleansing and stimulating unit supported on top of a releasable securing unit containing a dentifrice dispensing unit wherein the depletion of the dentifrice material enhances the ability of the releasable securing unit to adhere to a user's tongue.

As will be explained in greater detail further on in the specification, the cleansing/stimulating unit comprises a hollow head member the exterior surface of which is provided with a plurality of projections in the form of bristles and/or flexible nubbins adapted to remove food particles from between the front and rear crevices of the user's teeth and to stimulate and massage the adjacent gum surfaces to promote blood circulation in the gum tissues.

In addition, the releasable securing unit comprises a suction cup member the stem portion of which is adapted to fit into, and be connected to, the hollow head member wherein, the interior portion of the suction cup contains the dentifrice dispensing unit in the form of a rupturable membrane that cooperates with the interior surfaces of the suction cup member to define a reservoir chamber for a supply of dentifrice material such as mouthwash or the like.

Consequently, when the user places the dentifrice apparatus into their mouth on the top surface of their tongue, pressure can be applied between the tongue and the roof of the mouth to rupture the membrane and release the dentifrice supply while increasing the effective surface area of the suction cup member to adhere the apparatus to the user's tongue.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
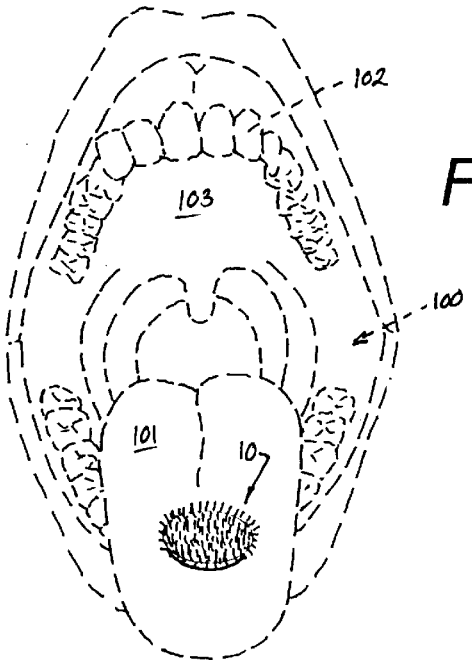
FIG. 1 is a front perspective view of the dentifrice apparatus in use.
Figure 4:
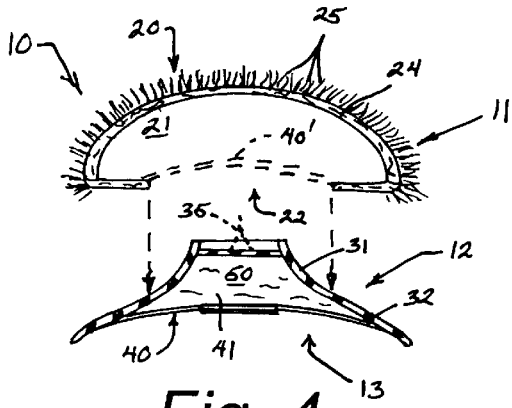
FIG. 4 is a cross-sectional view taken through line 4—4 of FIG. 3; and, FIG. 5 is a rear perspective view of the dentifrice apparatus as the rupturable membrane is breached to release the supply of dentifrice material.

As can be seen by reference to the drawings, and in particular to FIG. 1, the dentifrice apparatus that forms the basis of the present invention is designated generally by the reference number 10. Whereas, as shown in FIG. 4, the apparatus 10 comprises a cleansing/stimulating unit 11, a releasable securing unit 12, and a dentifrice dispensing unit 13. These units will now be described in seriatim fashion.

As can be seen by reference to FIGS. 2 through 5, the cleansing/stimulating unit 11 comprises an enlarged head member 20 having a hollow interior 21 formed by a central opening 22 in the bottom surface 23 of the head member 20 wherein, the top surface 24 of the head member 20 is provided with a plurality of outwardly extending projections 25 in the form of bristles and/or flexible nubbins the purpose and function of which will be explained in greater detail further on in the specification.

In the preferred embodiment of this invention, the head member 20 may be fabricated from soft rubber or plastic whereas, the outwardly extending projections 25 can be fabricated from rubber or soft plastic nubbins and/or flexible plastic bristle strands.

Figure 3:
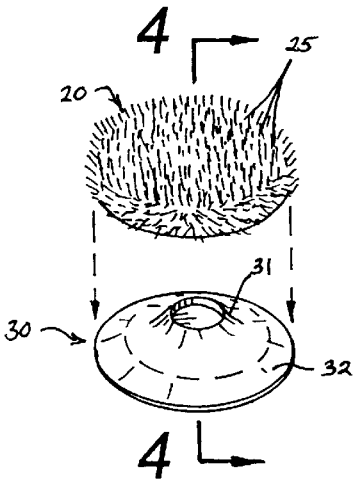
FIG. 3 is an isolated exploded perspective view of the cleansing/stimulating unit and the releasable securing unit.

As can best be seen by reference to FIGS. 3 and 4, the releasable securing unit 12 comprises a suction cup member 30 having a stem portion 31 and a deformable cup portion 32 wherein, the stem portion 31 is adapted to fit into the central opening 22 of the head member 20 and to be connected to the bottom surface 23 of the head member.

Figure 5:
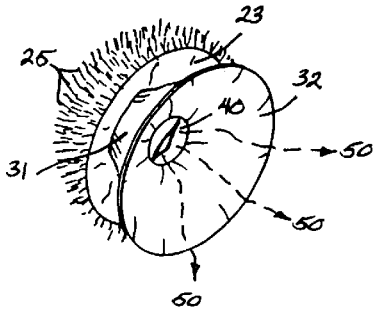

Turning now to FIGS. 4 and 5, it can be seen that the dentifrice dispensing unit 13 comprises a rupturable membrane member 40 extending across the interior of the cup portion 32 of the suction cup member 30 to define a reservoir 41 containing a supply of dentifrice material 50.

Figure 2:
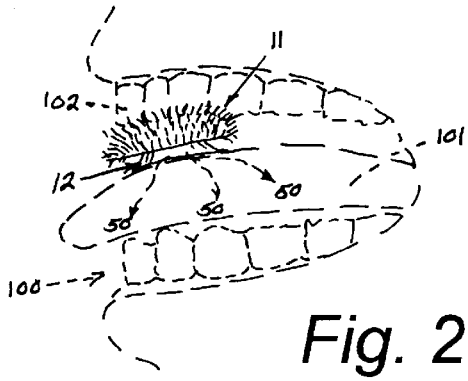
FIG. 2 is a side perspective view of the dentifrice apparatus in use.

As can best be seen by reference to FIGS. 1 and 2, the dentifrice apparatus 10 is inserted through the user's mouth

100 to rest on the user's tongue 101 whereupon, the user can manipulate their tongue 101 to position the apparatus 10 between the user's upper teeth 102 or the roof 103 of their mouth 100 to compress the apparatus 10 thereby breaching the rupturable membrane member 40 to release the dentifrice material 50 from the reservoir 41 which also expels air within the cup portion 32 of the suction cup member 30.

As a consequence, the suction cup member 30 will tightly adhere to the user's tongue 101 as the user manipulates their tongue to bring the projections 25 in the head member 20 against both the front and the rear surfaces of the user's teeth and gums from inside the user's mouth as opposed to the external entry required by a toothbrush.

Not only does this dentifrice apparatus provide a unique angle to remove food particles particularly from the back of the user's teeth while freshening their breath and massaging their gum tissues, but it also allows the user to accomplish this task discreetly in public places where the act of brushing one's teeth would neither be practical nor socially acceptable.

In addition, this unique design should substantially prolong the normal time spent on brushing the teeth and massaging gum surfaces thereby promoting better dental hygiene.

It should further be noted at this juncture that the dentifrice apparatus of this invention may also be adhered to the roof 103 of the user's mouth 100 to cleanse the top and sides of the user's tongue 101.

Returning once more to FIG. 4, it can be seen that in an alternate version of the preferred embodiment, the rupturable membrane 40 (depicted in phantom) may be provided in the hollow interior 21 of the head member 20 overlying the central opening 22 wherein, the top of the stem portion 31 of the suction cup member 30 may be provided with a prong 35 (depicted in phantom) for rupturing the membrane 40 when the head member 20 is compressed.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A dentifrice apparatus for cleansing a user's teeth, massaging their gum tissues and/or freshening their breath via the manipulation of the user's tongue wherein, the apparatus comprises:

a cleansing/stimulating unit including an enlarged head member having a top surface and a bottom surface wherein, the top surface is provided with a plurality of outwardly extending projections; and, first means for releasably securing the cleansing/stimulating unit to the user's tongue.

2. The apparatus as in claim 1; wherein, said plurality of projections on the top surface of the head member include flexible bristles.

3. The apparatus as in claim 1; wherein, said plurality of projections on the top surface of the head member include nubbins.

4. The apparatus as in claim 1; wherein, said plurality of projections on the top surface of the head member includes both bristles and nubbins.

5. The apparatus as in claim 1; wherein, said means for releasably securing the cleansing/stimulating unit to the user's tongue comprises a suction cup member having a stem portion and a cup portion wherein, the stem portion is operatively connected to the bottom surface of the head member.

6. The apparatus as in claim 5; wherein, said plurality of projections on the top surface of the head member include flexible bristles.

7. The apparatus as in claim 5; wherein, said plurality of projections on the top surface of the head member include nubbins.

8. The apparatus as in claim 5; wherein, said plurality of projections on the top surface of the head member includes both bristles and nubbins.

9. The apparatus as in claim 5; wherein, the bottom surface of the head member is provided with a central opening dimensioned to receive the stem portion of the suction cup member.

10. The apparatus as in claim 9; wherein, the enlarged head member has a hollow interior.

11. The apparatus as in claim 10 further comprising:

second means for dispensing a supply of dentifrice material from within a selected portion of the apparatus.

12. The apparatus as in claim 11; wherein, said second means for dispensing a supply of dentifrice material comprises a rupturable membrane extending across the hollow interior of the head member to create a reservoir for said supply of dentifrice material.

13. The apparatus as in claim 12; wherein, said plurality of projections on the top surface of the head member include flexible bristles.

14. The apparatus as in claim 12; wherein, said plurality of projections on the top surface of the head member include nubbins.

15. The apparatus as in claim 12; wherein, said plurality of projections on the top surface of the head member includes both bristles and nubbins.

16. The apparatus as in claim 12; wherein, the top of the stem portion of the suction cup member is provided with a prong adapted to breach said rupturable membrane.

17. The apparatus as in claim 11; wherein, said second means for dispensing a supply of dentifrice material comprises a rupturable membrane extending across the interior of the cup portion of the suction cup member to create a reservoir for said supply of dentifrice material.

18. The apparatus as in claim 17; wherein, said plurality of projections on the top surface of the head member include flexible bristles.

19. The apparatus as in claim 17; wherein, said plurality of projections on the top surface of the head member include nubbins.

20. The apparatus as in claim 17; wherein, said plurality of projections on the top surface of the head member includes both bristles and nubbins.

* * * * *